US006064345A

United States Patent [19]

Ohnishi et al.

[11] Patent Number: 6,064,345

[45] **Date of Patent: *May 16, 2000**

[54] GLASS ANTENNA DEVICE FOR AN AUTOMOBILE

[75] Inventors: Masahiro Ohnishi, Isehara; Masaru Shiina, Kanagawa; Yoji Nagayama, Matsusaka; Osamu Ueda, Tokyo, all of Japan

[73] Assignees: Asahi Glass Company Ltd., Tokyo; Nissan Motor Co., Ltd., Yokohama; Central Glass Company, Limited, Ube; Clarion Co., Ltd., Tokyo, all of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/985,911

[22] Filed: Dec. 5, 1997

[30] Foreign Application Priority Data

Dec. 6, 1996 [JP] Japan ..... 8-342477

[51] Int. Cl.[7] ..... H01Q 1/32

[52] U.S. Cl. ..... 343/713; 343/704

[58] Field of Search ..... 343/704, 711, 343/713

[56] References Cited

U.S. PATENT DOCUMENTS

| | | |
|---|---|---|
| 4,260,989 | 4/1981 | Ishii et al. . |
| 5,548,298 | 8/1996 | Nakase . |

FOREIGN PATENT DOCUMENTS

| | | |
|---|---|---|
| 0 353 515 | 2/1990 | European Pat. Off. . |
| 0 639 868 | 2/1995 | European Pat. Off. . |
| 58-16762 | 4/1983 | Japan . |
| 61-14170 | 5/1986 | Japan . |
| 1-12407 | 4/1989 | Japan . |
| 6-197036 | 7/1994 | Japan . |
| 8-18318 | 1/1996 | Japan . |
| 2 273 206 | 6/1994 | United Kingdom . |

*Primary Examiner*—Don Wong
*Assistant Examiner*—Tho Phan
*Attorney, Agent, or Firm*—Oblon, Spivak, McClelland, Maier & Neustadt, P.C.

[57] ABSTRACT

A glass antenna device for an automobile including a rear window glass sheet; an electric heating type defogger formed on the glass sheet, which is provided with heater strips and positive and negative bus bars for feeding a current to the heater strips; and a noise filter including at least a coil, which is connected between the positive bus bar and a positive terminal of a d.c. power source for the defogger. The negative bus bar is grounded to the automobile body, and antenna conductors are provided in a region in the rear window glass sheet other than the region where the defogger is formed. An antenna conductor element of the antenna conductors extends substantially parallel to the heater strips of the defogger, is more than half in length than a width of the rear window glass sheet, and is located in the range of 15 mm–50 mm apart from an end heating strip of the heating strips of the defogger nearest to the antenna conductor element. The coil has an inductance value in the range of 0.5–10 $\mu$H.

6 Claims, 15 Drawing Sheets

RELATION BETWEEN DISTANCE L OF ANTENNA-DEFOGGER AND S/N RATIO

RELATION BETWEEN CAPACITANCE C OF ANTENNA-DEFOGGER AND S/N RATIO

RELATION OF INDUCTANCE VALUE OF COIL 8 AND NOISE LEVEL OF ELECTRIC EQUIPMENT

RELATION AMONG DISTANCE L OF ANTENNA-DEFOGGER, INDUCTANCE VALUE OF COIL 8 AND S/N RATIO (f=540kHz)

RELATION AMONG DISTANCE L OF ANTENNA-DEFOGGER, INDUCTANCE VALUE OF COIL 8 AND S/N RATIO (f=900kHz)

RELATION AMONG DISTANCE L OF ANTENNA-DEFOGGER, INDUCTANCE VALUE OF COIL 8 AND S/N RATIO (f=1600kHz)

RELATION AMONG LENGTH OF ANTENNA CONDUCTOR ELEMENT, DISTANCE L OF ANTENNA-DEFOGGER AND S/N RATIO (f=900kHz, INDUCTANCE OF COIL 8 = 3μH)

RELATION AMONG LENGTH OF ANTENNA CONDUCTOR ELEMENT, DISTANCE L OF ANTENNA-DEFOGGER AND S/N RATIO (f=900kHz, INDUCTANCE OF COIL 8 = 0.1μH)

RELATION AMONG LENGTH OF ANTENNA CONDUCTOR ELEMENT, DISTANCE L OF ANTENNA-DEFOGGER AND S/N RATIO (f=900kHz, INDUCTANCE OF COIL 8 = 15μH)

COMPARISON OF NOISE QUANTITIES ENTERING IN ANTENNA

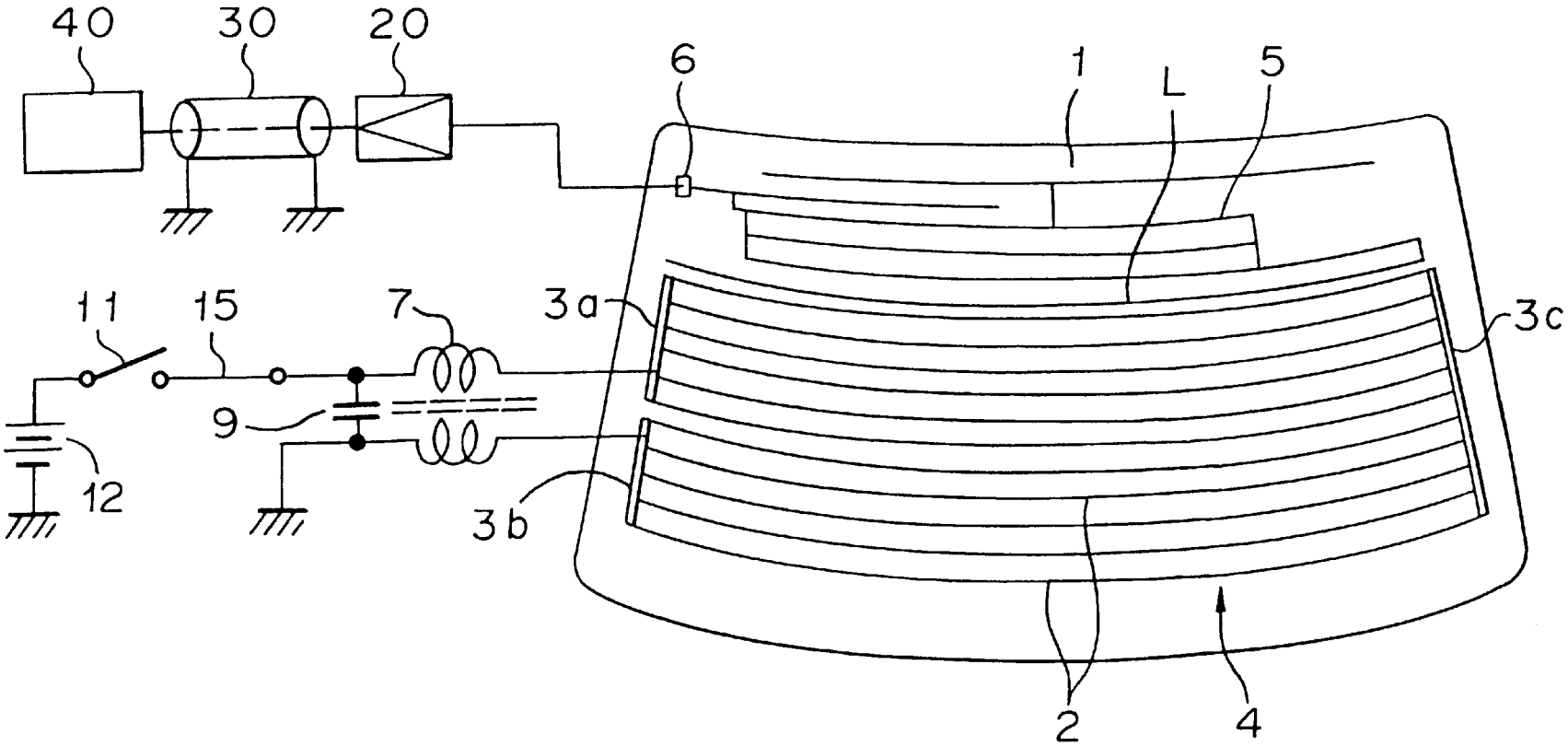
PRIOR ART FIGURE 17

GLASS ANTENNA DEVICE FOR AN AUTOMOBILE

BACKGROUND OF THE INVENTION

1. Field of the Invention

The present invention relates to a glass antenna device for an automobile provided on a rear window glass sheet of automobile, in particular, it relates to a glass antenna device for an automobile which is suitable for receiving AM broadcasting wave signals and for improving remarkably signal receiving sensitivity.

2. Discussion of Background

Generally, a glass antenna device for an automobile as shown in, for example, FIG. 17 has been known as an antenna device for receiving radio waves, which is mounted on an automobile.

In a rear window glass sheet 1 for an automobile, generally, a defogger 4 comprising heater strips 2 and bus bars 3*a*, 3*b*, 3*c* for feeding a current to the heater strips 2 is provided, and antenna conductors 5 are provided in an upper region of the rear window glass sheet 1 other than the region where the defogger 4 is provided.

The antenna conductors 5 have a pattern to function as an antenna which is formed by a method wherein a conductive metal-containing paste such as an electric conductive silver paste is printed on a surface of the rear window glass sheet 1 facing the interior side of the automobile, followed by baking. A signal received by the antenna conductors 5 is connected through a power feeding terminal 6 to a preamplifier 20 where the signal is amplified, and then, the amplified signal is transmitted to a receiver 40 through a feeder 30.

In the glass antenna device of this kind, a d.c. power 12 is connected to a positive side bus bar 3*a* of the defogger 4 by interposing a switch 11. In order to form an antenna of high gain in receiving AM broadcasting signals, a choke coil 7 having an inductance value of, for instance, about 1 mH is interposed as a noise filter between the d.c. power source 12 and the bus bars 3*a*, 3*b* of the defogger 4 so that the defogger 4 is maintained in a high frequency state with respect to the automobile body as the earth to thereby maintain a received signal voltage induced in the defogger 4, and at the same time, the distance L between the antenna conductors 5 and the defogger 4 is rendered to be about 5–10 mm so that a voltage induced in the defogger 4 is brought to a capacitive coupling relation to the antenna conductors 5. Further, in order to absorb noises generated in the automobile body which may enter into the d.c. power source 12, a capacitor 9 is connected as a noise filter in parallel to the d.c. power source 12.

In the conventional glass antenna device, however, it is essential to use the choke coil 7 having a large inductance value of about 1 mH in order to form an antenna of high gain to receive AM broadcasting wave signals. Use of such choke coil deteriorates productivity.

Further, since it was necessary to maintain the defogger 4 in a high frequency state in receiving the AM broadcasting wave signals, the defogger 4 had a high impedance with respect to the automobile body whereby the defogger 4 was apt to suffer noises from the automobile. In order to prevent such disadvantage, it was necessary to add a noise-preventing device for electrical equipments for the automobile. The noise-preventing device decreased the performance of the glass antenna device and productivity was inferior.

In addition, in the conventional glass antenna device, the choke coil 7 had to be connected to each of the positive side bus bar 3*a* and the negative side bus bar 3*b*. Accordingly, it was recommended to arrange the positive side bus bar 3*a* and the negative side bus bar 3*b* in a vertically separated state at an end side of the heater strips 2 from the standpoint of facilitating the wiring of the power source line 15. Accordingly, it was difficult to apply the above-mentioned arrangement to a defogger which is so designed that the positive side bus bar 3*a* and the negative side bus bar 3*b* are separately arranged at both sides of the heater strips 2, and therefore, flexibility in designing the defogger 4 was limited.

SUMMARY OF THE INVENTION

The present invention is to eliminate the above-mentioned problems and to provide a glass antenna device for an automobile which is hardly restricted in designing the defogger; excellent in productivity, and highly sensitive while noises can be suppressed.

Under such requirements, the inventors of this application have paid attention to the fact that when a negative side bus bar in the defogger is not grounded through a choke coil as in the conventional technique, but the negative side bus bar is grounded to the automobile body, the deterioration of sensitivity in receiving AM broadcasting wave signals due to the noises from the automobile can remarkably be reduced.

However, to connect simply the negative side bus bar of the defogger to the automobile body serving as ground results the technical problem as follows. Namely, a high frequency current induced in the antenna conductors leaks to the automobile body serving as ground through the defogger which has a capacitive coupling to the antenna conductors whereby a signal level to be inputted to a receiver substantially decreases.

Further, in a case that the defogger 4 is supplied with a current by using a noise filter including a coil having a high inductance value, the coil is magnetically saturated by a d.c. current as large as 10–20 A to loose function as the noise filter. As a result, when the defogger 4 is supplied with a current, it is impossible to prevent the deterioration of sensitivity due to the automobile noises.

In accordance with the present invention, there is provided a glass antenna device for an automobile comprising:

a rear window glass sheet, an electric heating type defogger formed on the glass sheet, which is provided with heater strips and bus bars for feeding a current to the heater strips, a noise filter including at least a coil, which is connected between an anode side bus bar and an anode of a d.c. power source for the defogger, and a cathode side bus bar connected to the automobile body as the earth, wherein antenna conductors are provided in a region in the rear window glass sheet other than the region where the defogger is formed;

an antenna conductor element which is extended in substantially parallel to the heater strips of the defogger and which is more than half in length of the width of the rear window glass sheet, is located 15 mm–50 mm apart from the end portion of defogger which is the nearest to the antenna conductors, and the coil has an inductance valve of 0.5–10 $\mu$H.

The glass antenna device for an automobile according to the present invention is so adopted to receive basically AM broadcasting wave signals. However, the present invention includes the glass antenna device capable of receiving FM broadcasting wave signals.

Further, in the present invention, any type of defogger can be chosen as far as the defogger is of an electric heating type provided with heater strips and a plurality of bus bars. For example, there are a one-way current feeding type wherein an anode side bus bar is provided at an end side of heater strips and a cathode side bus bar is at the other end side, or a channel-like current feeding type wherein an anode side bus bar and a cathode side bus bar are provided in a vertically separated state at an end side of heater strips and a current conductive bus bar is provided at the other end side.

With respect to a position where the antenna conductors are arranged, it may be in an upper region or a lower region of the defogger, or it may be separated at upper and lower regions, or it may be in a region other than the above-mentioned as far as the antenna conductors are arranged in a region other than the region where the defogger is provided.

It is preferable that the relative positional relation between the defogger and the antenna conductors is such that only the antenna conductors function as an antenna in an AM broadcasting wave region in almost no capacitive coupling relation.

Further, as the antenna conductors, a strip type antenna wherein an electric conductive metal-containing paste such as an electric conductive silver paste is printed on the cabin side surface of the rear window glass sheet of automobile followed by baking, is generally used. However, an antenna formed by using a transparent electric conductive film or an antenna wherein an electric conductive thin wires are embedded in an interlayer of a laminated glass may be used.

Further, with respect to patterning of the antenna conductors, an antenna conductor element which is arranged in substantially parallel to the heater strips of the defogger and which is more than half in length of the width of the rear window glass sheet, is required from the standpoint of receiving certainly AM broadcasting wave signals.

Further, it was confirmed experimentally that the antenna conductor element should be separated in a distance of 15–50 mm with respect to the end portion of the defogger near the antenna conductors from the viewpoint of improving the S/N ratio.

Further, from the viewpoint of improving the sensitivity of receiving FM broadcasting wave signals, it is preferable that a branch line is provided for the heater strips disposed at the end portion of the defogger near the antenna conductors to thereby adjust a degree of coupling between the defogger and the antenna conductors in an FM broadcasting frequency band region, so that the impedance of the antenna can be optimized.

In addition, any kind of noise filter can be used as far as it includes at least a coil. However, it has been confirmed experimentally that the inductance value of the noise filter should be determined to be 0.5–10 $\mu$H from the viewpoint of reducing the noise level.

There is disclosed Japanese Unexamined Patent Publication No. JP-A-8-18318 as prior art of the present invention. The publication discloses a glass antenna device for an automobile wherein an electric heating type defogger comprising heater strips and a plurality of bus bars for supplying a current to the heater strips is provided in a rear window glass sheet of automobile; a noise filter including at least a coil is connected between an anode side bus bar and the anode of a d.c. power source for the defogger; and a cathode side bus bar is connected to the automobile body as the earth.

However, the publication does not disclose features of the present invention that (1) an antenna conductor element which is arranged in substantially parallel to the heater strips of the defogger and which is more than half in length of the width of the rear window glass sheet is located 15 mm–50 mm apart from the end portion of defogger which is the nearest to the antenna conductors, and (2) the inductance value of the noise filter is determined to be 0.5–10 $\mu$H. The publication fails to suggest such features.

According to the technical features of the present invention, the antenna conductors have an antenna conductor element which is extended in substantially parallel to the heater strips of the defogger and which is more than half in length of the width of the width of the rear window glass sheet wherein the antenna conductor element is located 15–50 mm apart from the end portion of the defogger which is the nearest to the antenna conductors. Accordingly, a high frequency current induced in the antenna conductors can certainly be inputted to a receiver through the defogger without any leakage of current.

Further, the cathode side bus bar of the defogger is connected to the automobile body as the earth, and the inductance value of the coil of the noise filter between the anode side bus bar of the defogger and the d.c. power source is determined to be 0.5–10 $\mu$H. Accordingly, the defogger is maintained to be substantially at the same potential as the automobile body whereby the defogger does not suffer noises generated from the automobile, and the coil of the noise filter reduces the noises.

BRIEF DESCRIPTION OF THE DRAWINGS

A more complete appreciation of the invention and many of the attendant advantages thereof will be readily obtained as the same becomes better understood by reference to the following detailed descriptions when considered in connection with the accompanying drawings, wherein:

FIG. 17 is a diagram showing a conventional glass antenna device for an automobile.

DESCRIPTION OF PREFERRED EMBODIMENTS

Figure 1:
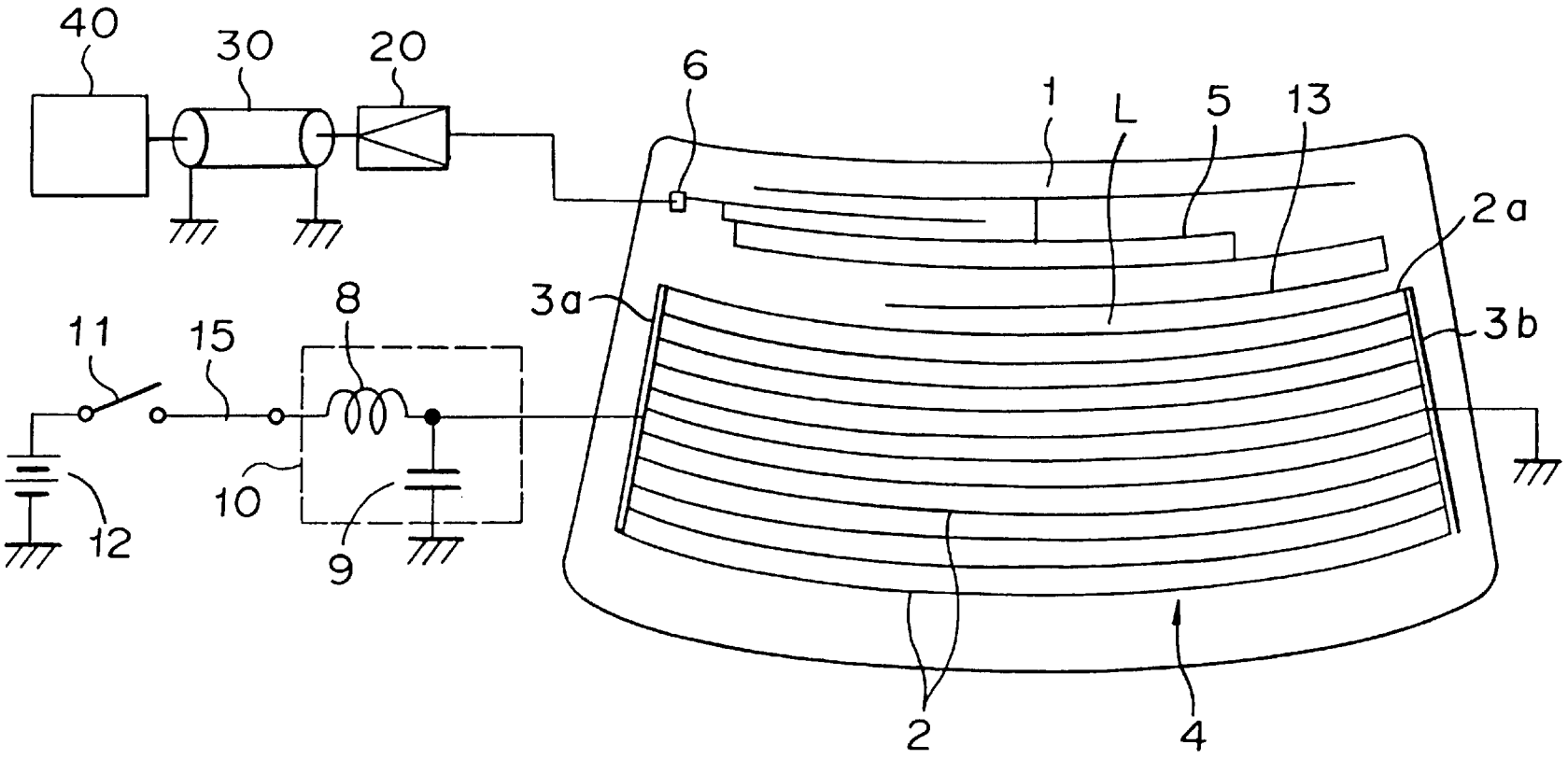
FIG. 1 is a diagram showing a first embodiment of the glass antenna device for an automobile according to the present invention.

Referring now to the drawings, wherein like reference numerals designate identical or corresponding parts throughout the several views, and more particularly to FIG. 1 thereof, there is illustrated a first embodiment of the glass antenna device for an automobile according to the present invention which is operable to receive AM radio waves and FM radio waves.

In FIG. 1, an electric heating type defogger 4 is provided in a rear window glass sheet 1 of automobile. In the first embodiment, the defogger 4 comprises a plurality of heater strips extending to a lateral direction (in a width direction) of the rear window glass sheet 1 and bus bars 3*a*, 3*b* provided at both sides of the heater strips 2 in order to supply a current to the heater strips 2. The heater strips are formed by, for example, printing an electric conductive metal-containing paste such as an electric conductive silver paste on the cabin side surface of the rear window glass sheet 1, followed by baking.

As shown in FIG. 1, the bus bar 3*a* at one side of the defogger 4, for instance, is connected in series to a d.c. power source 12 through a noise filter 10 and a switch 11 by means of a power source line 15, and the bus bar 3*b* at the other side is directly grounded to the automobile body as the earth through a lead wire.

In a region other than the region in the rear window glass sheet 1 where the defogger 4 is provided, for instance, in an upper region, antenna conductors 5 having a predetermined pattern and a power feeding terminal 6 are provided, and the power feeding terminal 6 is connected to a receiver 40 through a preamplifier 20 and a feeder 30.

As the antenna conductors 5 in the first embodiment, a strip type antenna formed by, for instance, printing an electric conductive metal-containing paste such as an electric conductive silver paste on the cabin side surface of the rear window glass sheet 1 of automobile, followed by baking.

In this embodiment, the antenna conductors 5 are provided in a range without substantial capacitive coupling with the defogger 4 (e.g., 50 pF or less in this embodiment) whereby only the antenna conductors 5 function as an antenna in an AM radio frequency region. In the first embodiment, in particular, the antenna conductors 5 have an antenna conductor element 13 which is arranged in substantially parallel to the heater strips 2 and which is more than half in length than the width of the rear window glass sheet 1 wherein the distance (space) between the antenna conductor element 13 and the heater strip 2*a* at the highest position which is located at the upper end of the defogger 4 is determined to be 15 mm–50 mm.

There are various types of noises generated from various electric equipments mounted on an automobile, such as noises in a switch system, noises in an ignition system, noises in a motor system and so on. When these noises enter in the power source line 15 for the defogger 4, the noises which have high frequency components are introduced into the antenna conductors 5 through the defogger 4 to generate noises in the receiver 40. The noise filter 10 is to prevent the generation of noises in the receiver 40. In the first embodiment, the noise filter 10 is constituted by, for instance, a coil 8 connected in series between the positive side bus bar 3*a* and the positive terminal of the d.c. power source 12 and a capacitor 9 connected in parallel between the positive and the negative terminals of the d.c. power source 12.

The characteristic feature of this embodiment is to determine the inductance value of the coil 8 of the noise filter 10 to be in a range of 0.5–10 $\mu$H.

The operation of the glass antenna device for an automobile according to this embodiment will be described.

It is possible to cause resonance by an FM broadcasting frequency since the antenna conductors 5 have a length of ¼ wavelength or more than a signal receiving frequency. Further, the defogger 4 is resonated by the FM broadcasting frequency to function as an antenna. However, the invasion of noises from the side of the d.c. power source 12 is prevented because it is grounded in terms of high frequency by means of the capacitor 9 of the noise filter 10.

In an AM broadcasting frequency band region, since the bus bar 3*b* at one side of the defogger 4 is directly grounded to the automobile body, the defogger 4 is at the same potential as the automobile body whereby the defogger 4 does not function as an antenna and it is deemed to be a part of the automobile body. Accordingly, only the antenna conductors 5 function as an antenna. Further, since the noise filter 10 is connected to the bus bar 3*a* at the other side of the defogger 4, noise is prevented from entering from the side of the d.c. power source 12.

In order to confirm the above-mentioned function, the inventors study on the distance (space) L between the antenna conductor element 13 which is more than half in length than the width of the rear window glass sheet 1 and the heater strip 2*a* at the highest position of the defogger 4 and the inductance value of the coil of the noise filter 10 inserted in the power source line 15 for the defogger 4 in the first embodiment. An experimental result of the relation among the distance L, the inductance value and the AM radio receiving sensitivity (S/N ratio) is described below.

Figure 2:
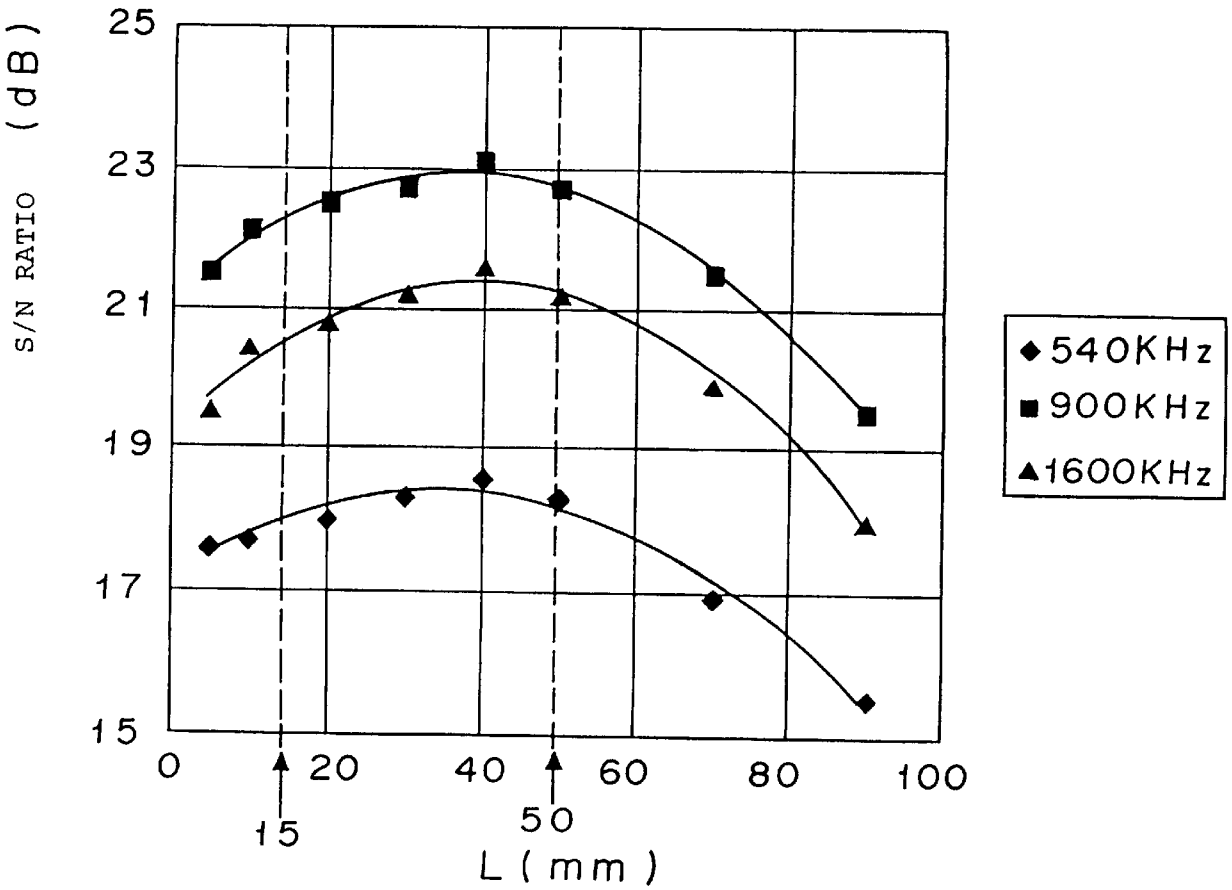
FIG. 2 is a characteristic diagram showing the relation between a distance L of antenna-defogger and the S/N ratio in the first embodiment.

FIG. 2 is a diagram showing the relation of the distance L between the antenna conductor element 13 which is more than half in length of the width of the rear window glass sheet 1 and the heater strip at the highest position of the defogger 4 (the distance of antenna-defogger) to the S/N ratio with respect to typical three frequencies (540 kHz, 900 kHz and 1600 kHz) in an AM broadcasting band region. As is clear from FIG. 2, it was found that the S/N ratio tends to be deteriorated when the distance L is less than 15 mm; it tends to be improved mildly when the distance L is 15 mm or more; and when the distance exceeds 50 mm, the sensitivity tends to be deteriorated due to the reduction of the surface area of the antenna.

Figure 3:
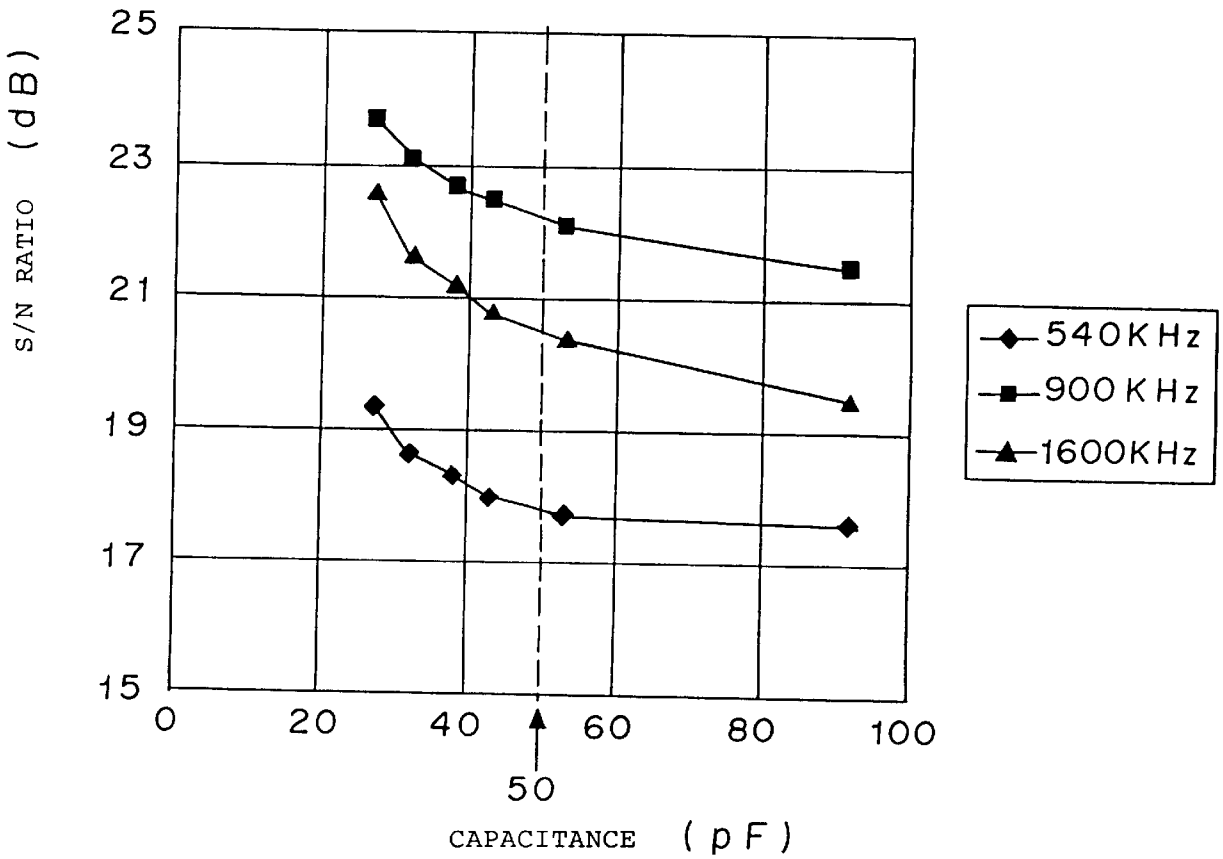
FIG. 3 is a characteristic diagram showing the relation of a capacitance C of antenna-defogger to the S/N ratio in the first embodiment.

FIG. 3 shows the relation of the capacitance C between the antenna conductors 5 and the defogger 4 (the capacitance of antenna-defogger) to the S/N ratio with respect to typical three frequencies of AM broadcasting band region (540 kHz, 900 kHz and 1600 kHz).

In FIG. 3, it was found that with respect to the capacitance C of antenna-defogger, the S/N ratio could be improved by determining the capacitance C to be about 50 pF or less.

Figure 4:
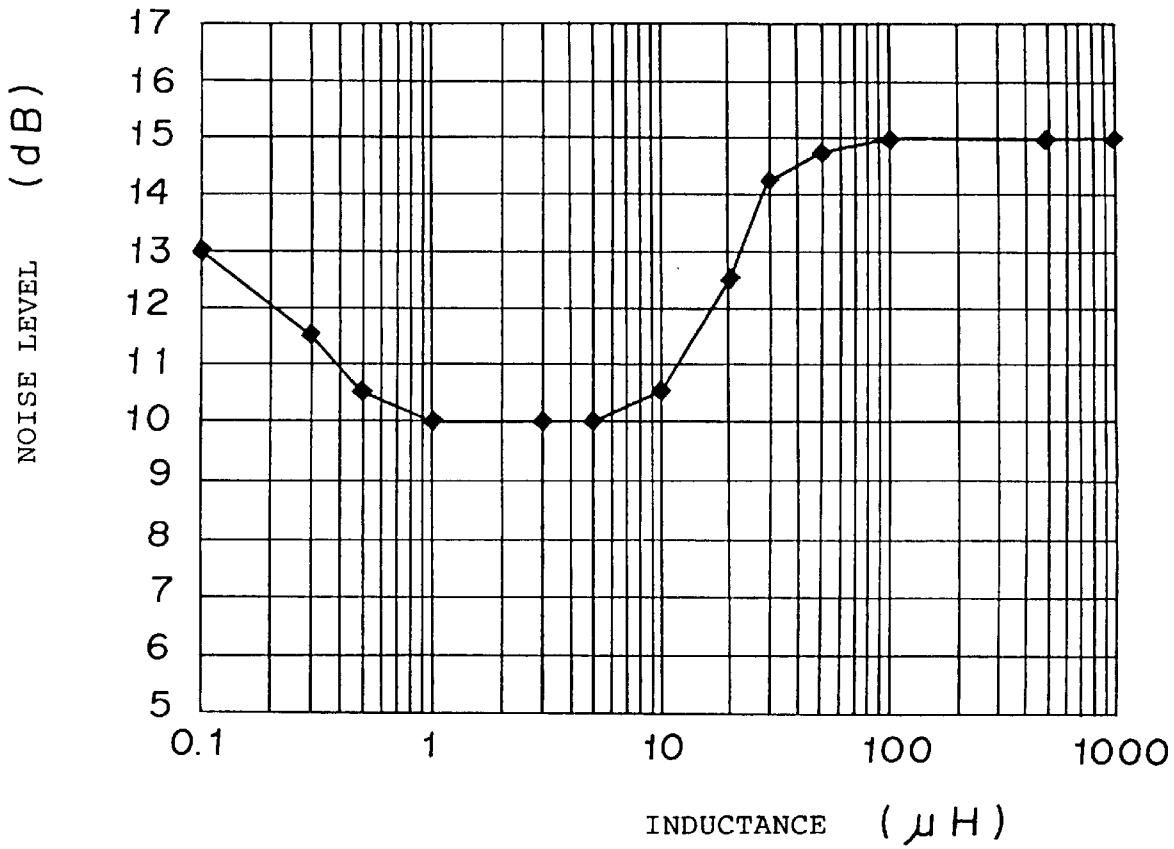
FIG. 4 is a characteristic diagram showing the relation of an inductance value of the noise filter to a noise level of an electrical equipment in the first embodiment.

In the experiments shown in FIGS. 2 and 3, the inductance of the coil 8 of the noise filter 10 is determined to be 3 $\mu$H. However, it has been found that the noise level can be reduced by determining the inductance value to be 0.5–10 $\mu$H in the relation of the inductance value of the coil of the noise filter 10 to the noise level caused by the electric equipments as shown in FIG. 4.

Figure 5:
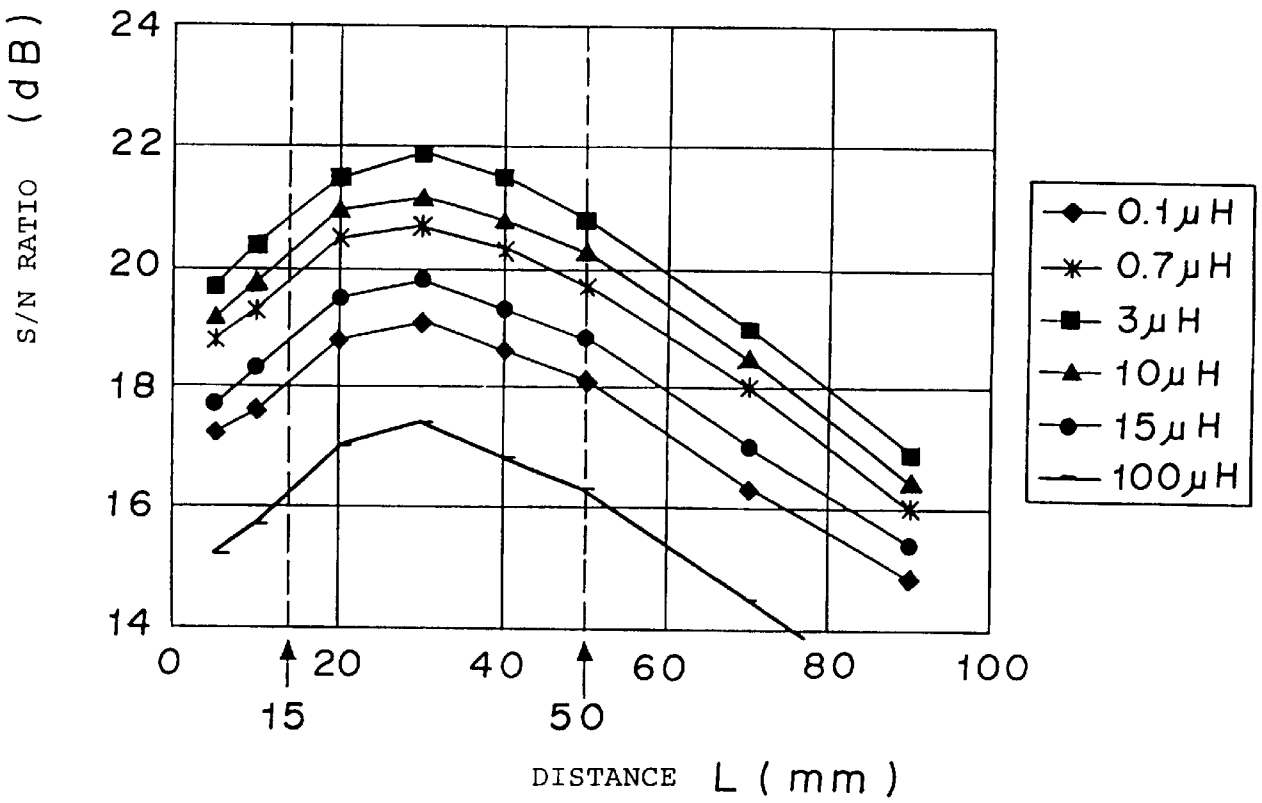
FIG. 5 is a characteristic diagram showing the relation among a distance L of antenna-defogger, an inductance value of the coil of the noise filter and an S/N ratio with respect to a lower limit frequency (f=540 kHz) in an AM broadcasting band in the first embodiment.
Figure 6:
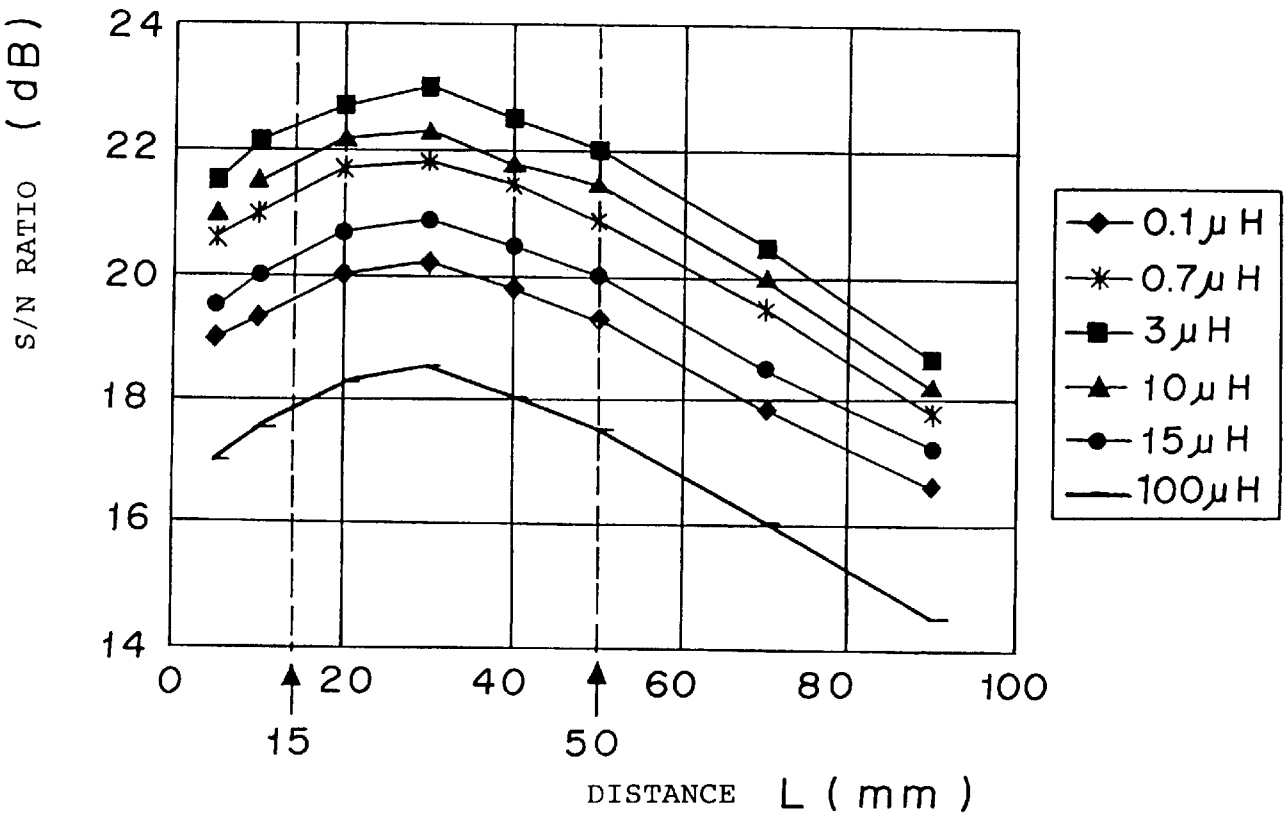
FIG. 6 is a characteristic diagram showing the relation among a distance of antenna-defogger, an inductance value of the coil of the noise filter and an S/N ratio with respect to an intermediate frequency (f=900 kHz) in an AM broadcasting band in the first embodiment.
Figure 7:
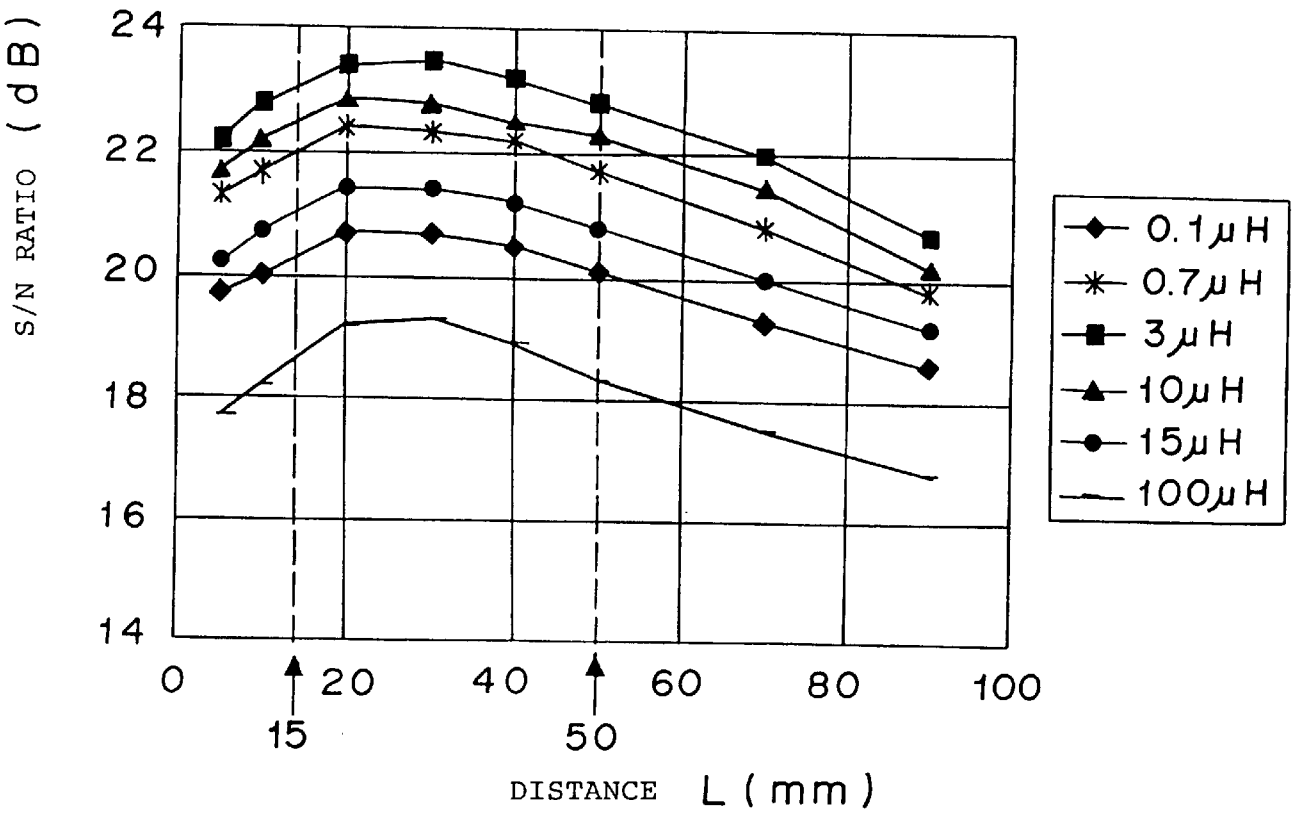
FIG. 7 is a characteristic diagram showing the relation among a distance of antenna-defogger, an inductance value of the coil of the noise filter and an S/N ratio with respect to an upper limit frequency (f=1600 kHz) in an AM broadcasting band in the first embodiment.

Further, FIGS. 5 to 7 respectively show the characteristics in the relation among a distance L of antenna-defogger (which corresponds to a distance between the antenna conductor element 13 and the heater strip of the highest position 2*a*), an inductance value of the noise filter 10 and an S/N ratio in the first embodiment wherein FIG. 5 shows a graph based on a frequency near the lower limit of an AM broadcasting band (i.e., 540 kHz in this embodiment), FIG. 6 shows a graph based on an intermediate frequency of the AM broadcasting band (i.e., 900 kHz in this embodiment) and FIG. 7 shows a graph based on a frequency near the upper limit of the AM broadcasting band (i.e., 1600 kHz in this embodiment).

FIGS. 5 to 7 reveal that excellent S/N ratios can be obtained at each of frequencies when the distance L of antenna-defogger is determined to be 15 mm–50 mm and the inductance value of the noise filter 10 is to be 0.5 $\mu$H–10 $\mu$H.

Figure 8:
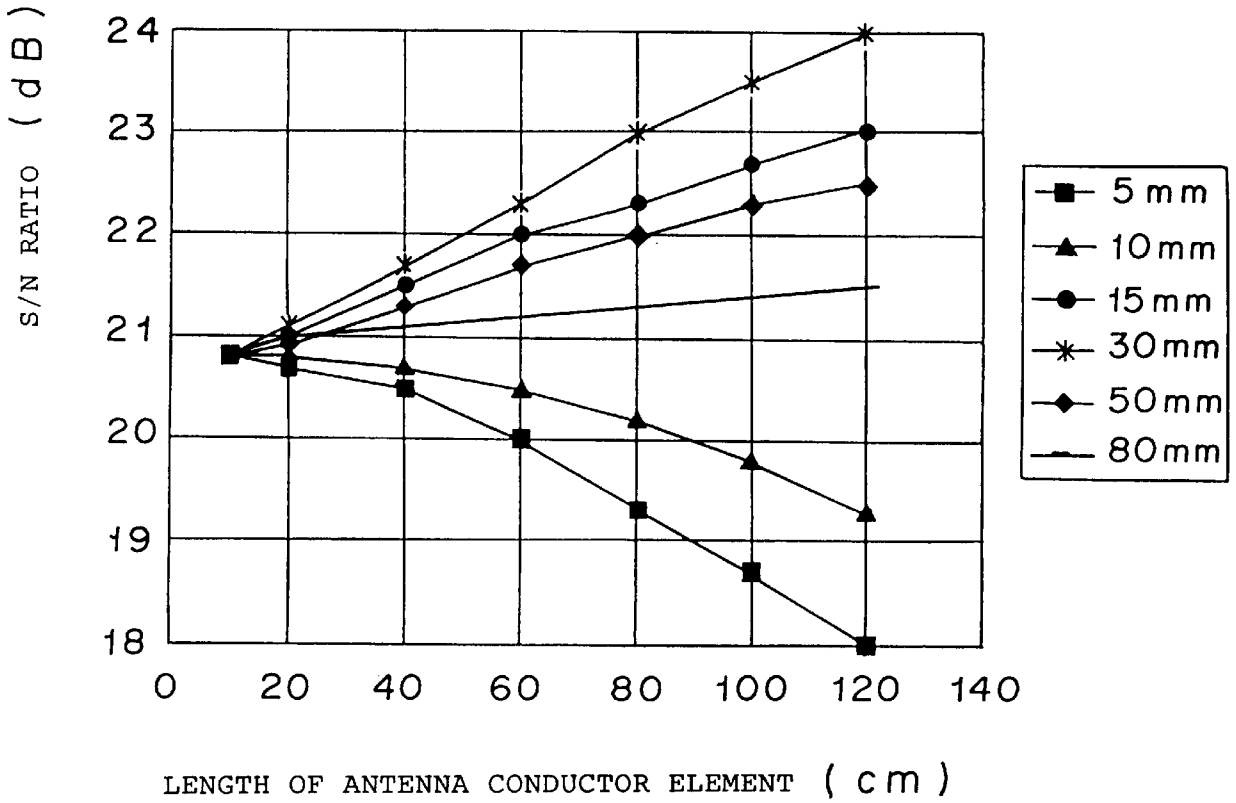
FIG. 8 is a characteristic diagram (the inductance value of the Coil of the noise filter: 3 $\mu$H) showing the relation among a length of an antenna conductor element 13, a distance L of antenna-defogger and an S/N ratio in the first embodiment.

FIG. 8 shows the characteristics in the relation among a length of the antenna conductor element 13, a distance L of antenna-defogger and an S/N ratio under the conditions of an AM broadcasting band frequency f of 900 kHz and an inductance value of the filter 10 of 3 $\mu$H.

Figure 9:
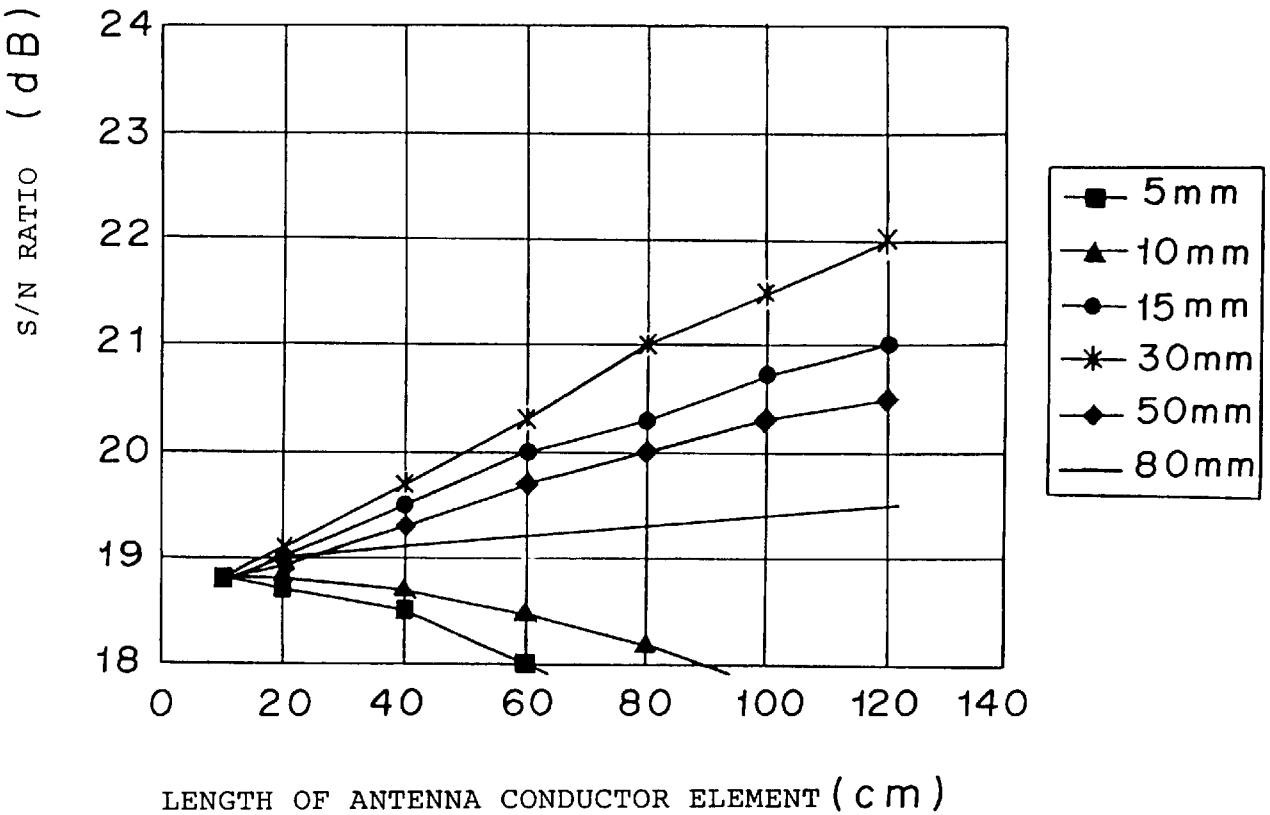
FIG. 9 is a characteristic diagram (the inductance value of the coil of the noise filter: 0.1 $\mu$H) showing the relation among a length of an antenna conductor element 13, a length L of antenna-defogger and an S/N ratio in an embodiment for comparison.
Figure 10:
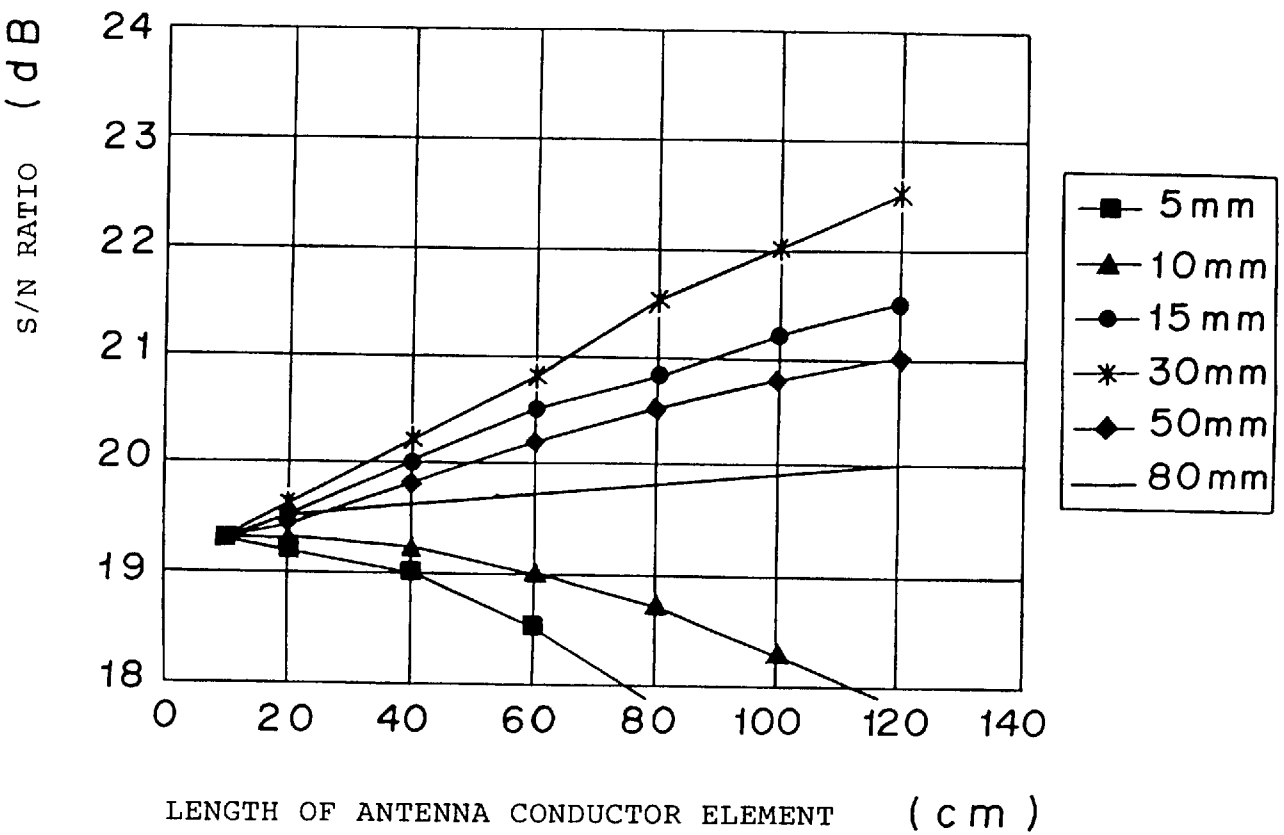
FIG. 10 is a characteristic diagram (the inductance value of the coil of the noise filter: 15 $\mu$H) showing the relation among a length of an antenna conductor element 13, a distance L of antenna-defogger and an S/N ratio in another embodiment for comparison.
Figure 15:
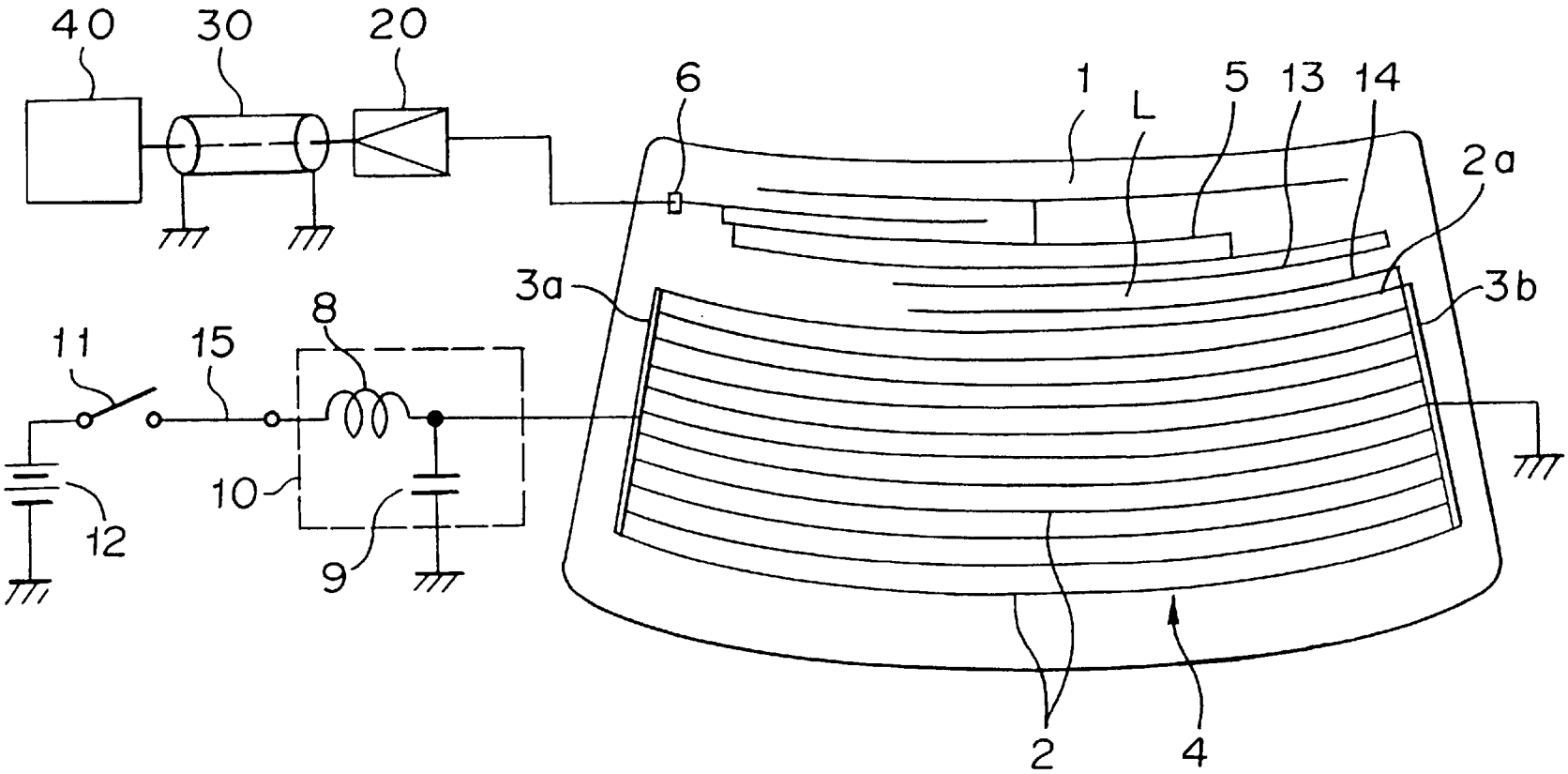
FIG. 15 is a diagram showing a second embodiment of the glass antenna device for an automobile according to the present invention.

FIGS. 9 and 10 show the characteristics in the relation among a length of the antenna conductor element 13, a distance L of antenna-defogger and an S/N ratio under the conditions that the AM broadcasting band frequency f is 900 kHz, and inductance value of the noise filter 10 is different, i.e., 0.1 $\mu$H for FIG. 9 and 15 $\mu$H for FIG. 10.

FIG. 8 reveals that an excellent S/N ratio can be obtained when the length of the antenna conductor element 13 is more than half in length of the width than the rear window glass sheet of automobile (i.e., 900 mm in this embodiment) and the distance L of the antenna-defogger is in a range of 15 mm–50 mm. In this case, the width in the lateral direction of the rear window glass sheet 1 is 1400 mm.

Further, in FIGS. 8 to 10, it is understood that excellent S/N ratios can be obtained when the inductance value of the coil 8 is 3 $\mu$H in comparison with a case of 0.1 $\mu$H or 15 $\mu$H.

Figure 11:
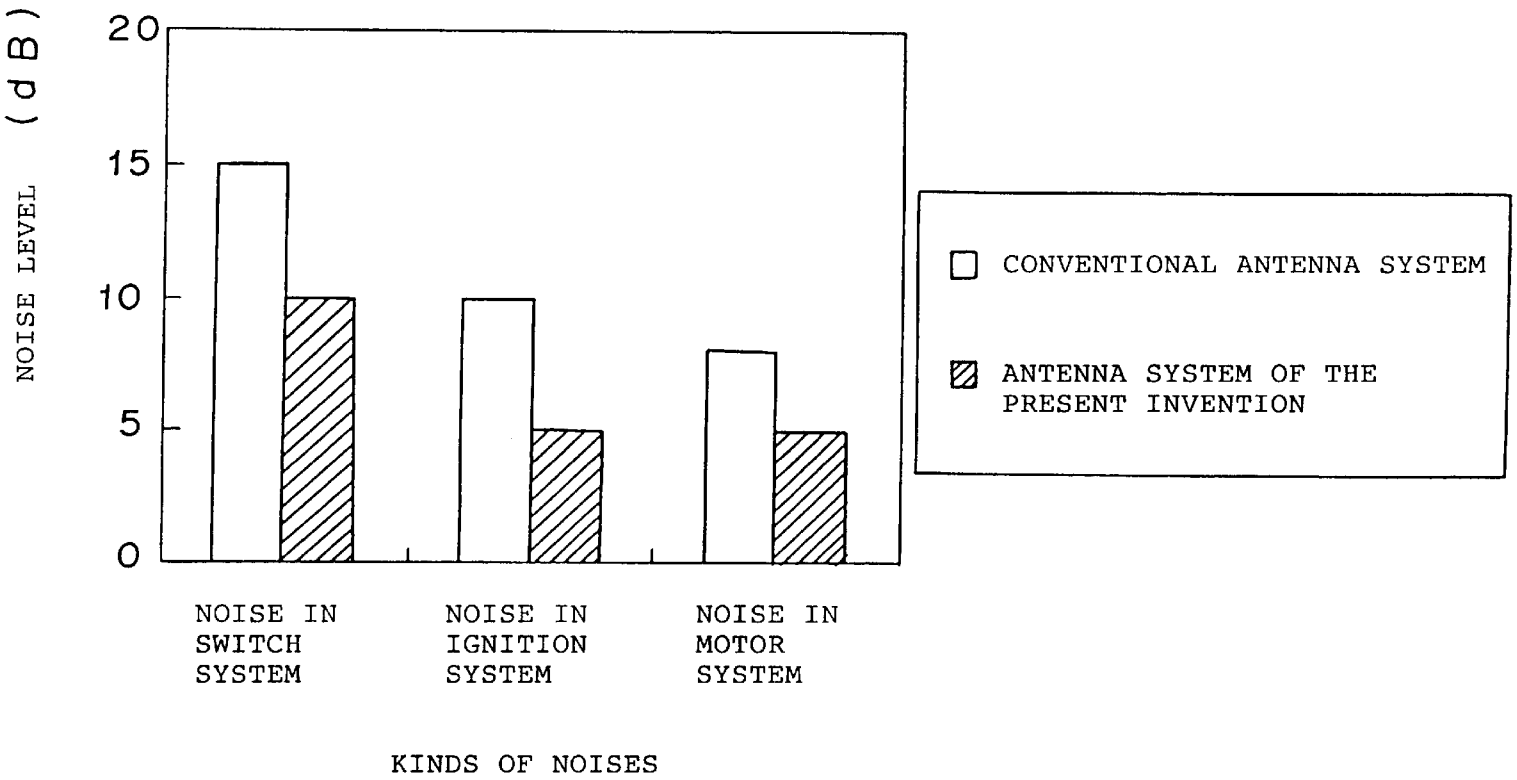
FIG. 11 is a characteristic diagram showing noise quantities received by the antenna system of the present invention and the conventional antenna system.

FIG. 11 is a graph showing in comparison noise quantities entering into the antenna conductors in the antenna device according to the present invention and the conventional antenna device (FIG. 17). In FIG. 11, it is understood that the antenna device according to the present invention can remarkably reduce the quantity of various kinds of noises entering into the antenna conductors in comparison with the conventional antenna device.

Thus, in accordance with the first embodiment of the present invention, the glass antenna device for an automobile having an excellent S/N ratio can be realized by reducing the noise quantities entering into the antenna conductors in comparison with the conventional glass antenna device for an automobile.

Further, it is unnecessary for a part constituting the noise filter 10 to use a choke coil having a large inductance such as about 1 mH, and the coil 8 having a low inductance value of 10 $\mu$H or lower which does not cause a problem of magnetic saturation at the current feeding time to the defogger 4 can sufficiently be used. Accordingly, miniaturization size, reduction of weight and improvement of productivity are possible.

Figure 12:
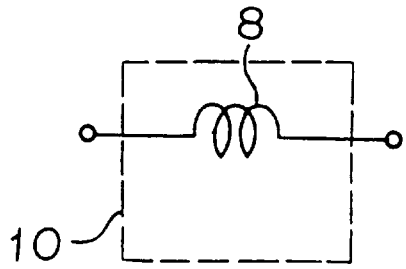
FIG. 12 is a circuit diagram showing a modified embodiment of the noise filter used in the first embodiment.
Figure 13:
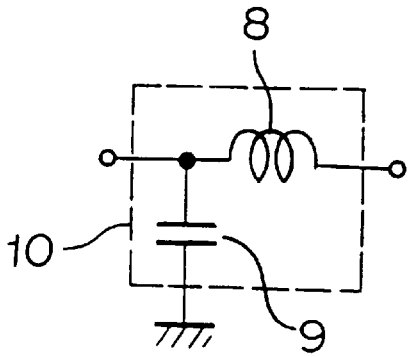
FIG. 13 is a circuit diagram showing another modified embodiment of the noise filter used for the first embodiment.
Figure 14:
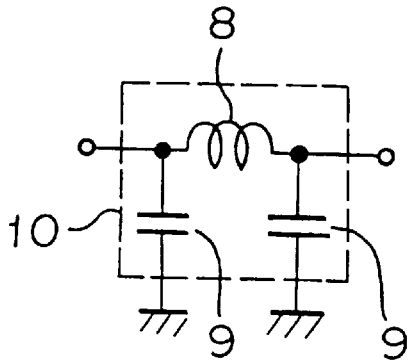
FIG. 14 is a circuit diagram showing still another modified embodiment of the noise filter used for the first embodiment.

In the first embodiment, the construction of the noise filter 10 is not limited to that as shown in FIG. 1, but various options may be chosen. For example, the noise filter 10 may be constituted by only the coil 8 as shown in FIG. 12, which depends on the kinds and the strength of noises generated from electric equipments, or the capacitor 9 may be arranged at the side of the d.c. power source 12 with respect to the coil 8 as shown in FIG. 13, or the capacitor 9 may be arranged at both sides, i.e., at the side of the d.c. power source 12 and the side of the defogger 4 of the coil 8 respectively.

FIG. 15 shows a second embodiment of the glass antenna device for an automobile according to the present invention. The construction of the glass antenna device of the second embodiment is substantially the same as that of the first embodiment provided that a branch line 14 which extends in substantially parallel to the heater strip 2*a* at the highest position in the defogger 4 and which is more than half in length of the width of the rear window glass sheet 1, is branched from the upper end of the negative side bus bar 3*b*, and the distance L between the branch line 14 and the antenna conductor element 13 in the antenna conductors 5, which is more than half in length of the width of the rear window glass sheet 1, is determined to be 15 mm–50 mm. In FIG. 5, the same reference numerals designate the same or corresponding parts of the first embodiment, and therefore, description of these parts is omitted.

The operation of the glass antenna device for an automobile according to the second embodiment will be described.

In an FM broadcasting band region, it is possible to cause resonance by an FM broadcasting band frequency since the antenna conductors 5 have a length of more than ¼ wavelength of the signal receiving frequency. Further, the defogger 4 also resonates at an FM broadcasting band frequency to operate as an antenna. However, the defogger is isolated with respect to high frequency by means of the capacitor 9 of the noise filter 10, whereby noises from the side of the d.c. power source 12 are prevented from entering. Then, the branch line 14 branched from the heater strip 2*a* at the highest position in the defogger 4 adjusts a degree of coupling of the defogger 4 with the antenna conductor 5 in the FM broadcasting frequency band region whereby the impedance of the antenna is optimized, and sensitivity to receive FM broadcasting frequency signals is improved.

Further, when the bus bar 3*b* at one side of the defogger 4 is directly grounded to the automobile body in an AM broadcasting band frequency, the defogger 4 has the same potential as the automobile body and the defogger 4 does not operate as the antenna conductors 5 so that it is deemed as a part of the automobile body. Accordingly, only the antenna conductors 5 function as the antenna. Further, noises from the side of the d.c. power source 12 are prevented from entering by means of the noise filter 10 connected to the bus bar 3*a* at the other side of the defogger 4. In this case, since the length of the branch line 14 is very short in comparison with the wavelength of the AM broadcasting band frequency, and the defogger 4 has the same potential as the automobile body (i.e.,ground), so that the branch line 14 is deemed to be a part of the automobile body.

According to the second embodiment, the relation between the distance L of the antenna conductor element 13 to the branch line 14 and the AM radio signal receiving sensitivity (S/N ratio) was examined in the same manner as embodiment 1. As a result, it has been confirmed that an excellent S/N ratio can be obtained under the condition that the inductance value of the coil 8 is 0.5 $\mu$H–10 $\mu$H provided that the distance L between the antenna conductor element 13 and the branch line 14 is in a range of 15 mm–50 mm.

Figure 16:
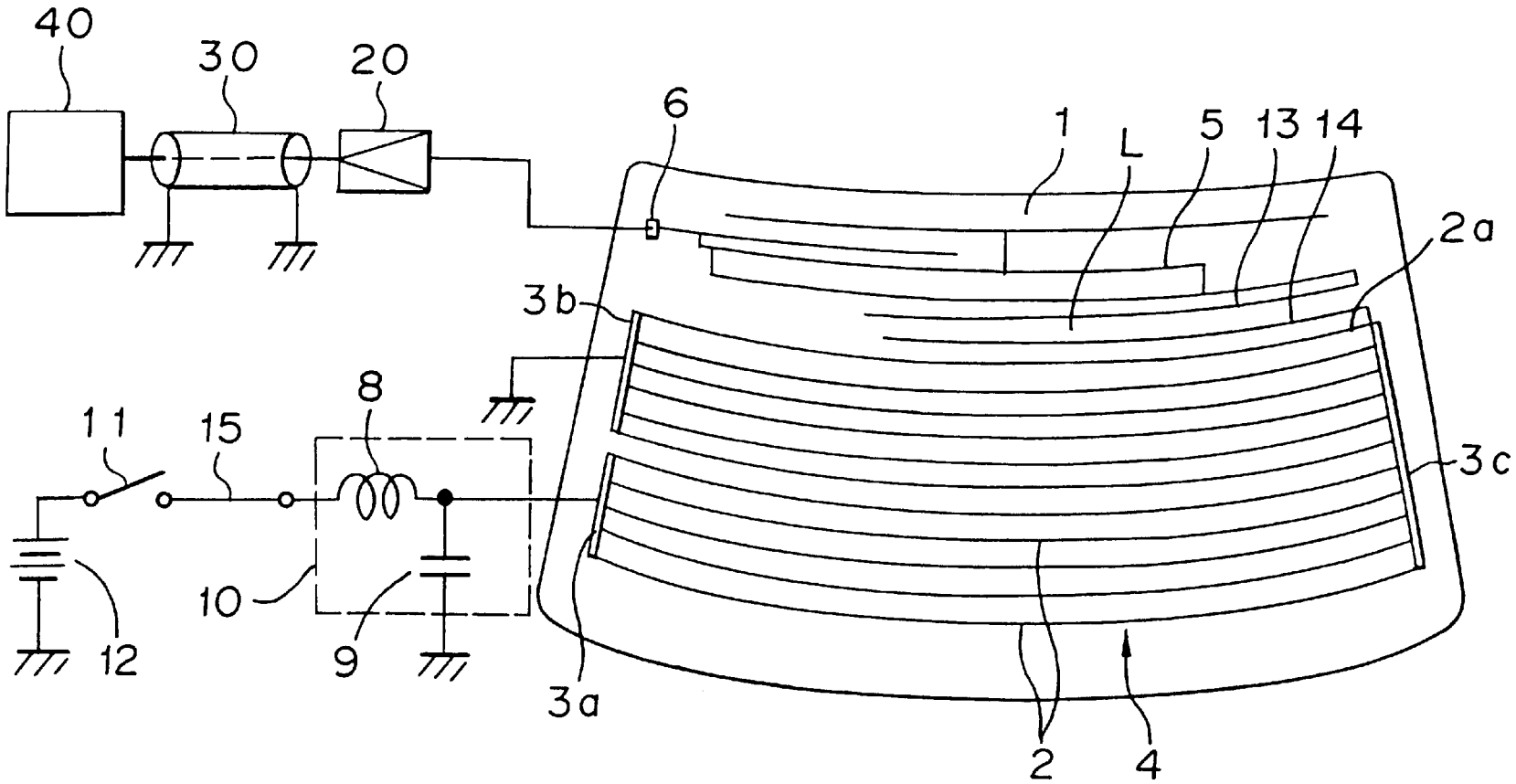
FIG. 16 is a diagram showing a third embodiment of the glass antenna device for an automobile according to the present invention.

FIG. 16 shows a third embodiment of the glass antenna device for an automobile according to the present invention. The glass antenna device of the third embodiment has substantially the same construction as the second embodiment except for the construction of the defogger 4. Namely, the defogger 4 in the third embodiment comprises a plurality of heater strips arranged in a lateral direction in the rear window glass sheet 1, a positive side bus bar 3*a* and a negative side bus bar 3*b* which are provided at an end side of the heater strips 2 in vertically separated state, and an electric conducting bus bar 3*c* provided at the other side of the heater strips 2 wherein the heater strips 2 are so arranged to have a channel-like electric conducting pattern.

In this embodiment, the distance L between the branch line 14 branched from the heater strip 2*a* at the highest position and the antenna conductor element 13 in the antenna conductors 5 is determined to be 15 mm–50 mm.

Further, the positive side bus bar 3*a* located at one side of the defogger 4 is connected in series to d.c. power source 12 by means of the power source line 15 in which the noise filter 10 and the switch 11 are interposed, and the negative side bus bar 3*b* is grounded in series to the automobile body by means of a lead wire.

In the third embodiment, the noise filter 10 is constituted by the coil 8 connected in series between the positive side bus bar 3*a* and the positive terminal of the d.c. power source 12 and the capacitor 9 connected in parallel between the anode and the cathode of the d.c. power source 12 wherein the inductance of the coil 8 is determined in a range of 0.5–10 $\mu$H.

The relation between the distance L between the antenna conductor element 13 and the branch line 14 to the AM radio signal receiving sensitivity (S/N ratio) was examined in order to confirm that the third embodiment performed the same effect as the second embodiment. As a result, it was confirmed that an excellent S/N ratio could be obtained under the conditions that the inductance value of the coil 8 is 0.5 $\mu$H–10 $\mu$H and the distance L between the antenna conductor element 13 and the branch line 14 is in a range of 15 mm–50 mm.

This embodiment can be applied to the first embodiment as a matter of course.

Thus, according to the present invention, the distance between the defogger and the antenna conductor element in the antenna conductors, which is more than half in length of the width of the rear window glass sheet is optimized, and a high frequency current induced in the antenna conductance at the time of receiving AM broadcasting band signals is certainly inputted into a receiver through the defogger without any leakage to the automobile body. Accordingly, the sensitivity of receiving AM radio signals (S/N ratio) can be improved.

Further, according to the present invention, the inductance value of the coil of the noise filter connected to the positive side bus bar of the defogger is optimized, and noises can effectively be reduced by the noise filter. Accordingly, deterioration of sensitivity due to noises generated from the automobile can be prevented regardless of an electric current condition in the defogger. Accordingly, the antenna device can be rendered to be highly sensitive with less influence of noises generated from various electric equipments mounted on the automobile. Such structure facilitates to reduce noises from the electrical equipments in comparison with the conventional glass antenna device. Further, a choke coil having a large inductance is unnecessary. According, productivity can be improved, and reduction of weight can be achieved by miniaturizing the noise filter.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A glass antenna device for an automobile comprising:

a rear window glass sheet;

an electric heating type defogger formed on the glass sheet, which is provided with heater strips and positive and negative bus bars for feeding a current to the heater strips; and a coil having an end which is connected to the positive bus bar and another end which is connected a positive terminal of a d.c. power source for the defogger;

wherein the negative bus bar is physically and directly grounded to the automobile body;

antenna conductors are provided in a region in the rear window glass sheet other than the region where the defogger is formed;

an antenna conductor element of the antenna conductors extends substantially parallel to the heater strips of the defogger, is more than half in length than a width of the rear window glass sheet, and is located in the range of 15 mm–50 mm apart from an end heating strip of the heating strips of the defogger nearest to the antenna conductor element;

said coil has an inductance value in the range of 0.5–10 $\mu$H; and a capacitance between said antenna conductors and said defogger is 50 pf or less.

2. The glass antenna device according to claim 1, wherein the negative bus bar is directly grounded to the automobile body.

3. The glass antenna device according to claim 1, wherein said capacitance between said antenna conductors and said defogger is 50 pf or less as measured with said negative bus bar not grounded to said automobile body.

4. A glass antenna device for an automobile comprising a rear window glass sheet;

an electric heating type defogger formed on the glass sheet, which is provided with heater strips and positive and negative bus bars for feeding a current to the heater strips; and a coil having an end which is connected to the positive bus bar and another end which is connected a positive terminal of a d.c. power source for the defogger;

wherein the negative bus bar is physically and directly grounded to the automobile body;

antenna conductors are provided in a region in the rear window glass sheet other than the region where the defogger is formed, an antenna conductor element of the antenna conductors extends substantially parallel to the heater strips of the defogger, is more than half in length than a width of the rear window glass sheet, and is located in the range of 15 mm–50 mm apart from an end heating strip of the heating strips of the defogger nearest to the antenna conductor element; and said coil has an inductance value in the range of 0.5–10 $\mu$H.

5. The glass antenna device according to claim 4, wherein a capacitance between said antenna conductors and said defogger is 50 pf or less.

6. The glass antenna device according to claim 5, wherein said capacitance between said antenna conductors and said defogger is 50 pf or less as measured with said negative bus bar not grounded to said automobile body.

* * * * *